United States Patent [19]

Dettelbach et al.

[11] Patent Number: 4,668,248

[45] Date of Patent: May 26, 1987

[54] GRINDING DISK AND METHOD OF MANUFACTURING SUCH A DISK

[75] Inventors: Alfred Dettelbach, Stuttgart; Rolf Seyfang, Neckartailfingen, both of Fed. Rep. of Germany

[73] Assignee: Reich Spezialmaschinen GmbH, Nuertingen, Fed. Rep. of Germany

[21] Appl. No.: 825,762

[22] Filed: Jan. 31, 1986

Related U.S. Application Data

[62] Division of Ser. No. 717,075, Mar. 28, 1985, abandoned.

[30] Foreign Application Priority Data

Apr. 11, 1984 [DE] Fed. Rep. of Germany ..... 3413598

[51] Int. Cl.[4] ..... B24D 11/00

[52] U.S. Cl. ..... 51/293; 51/206.4; 51/206 P; 51/397

[58] Field of Search ..... 51/206 R, 206 P, 206.4, 51/206.5, 207, 168, 266, 397, 395, 376, 358, 330, 331, 354, 363, 293, 297, 299

[56] References Cited

U.S. PATENT DOCUMENTS

| | | | |
|---|---|---|---|
| 750,653 | 1/1904 | Hyde | 51/206.5 |
| 1,783,727 | 12/1930 | Larsson | 51/168 |
| 2,001,911 | 5/1935 | Wooddell et al. | 51/397 |
| 2,115,897 | 5/1938 | Wooddell et al. | 51/397 |
| 2,743,559 | 5/1956 | Bell et al. | 51/397 |
| 4,535,574 | 8/1985 | Dettelbach et al. | 51/204 |

FOREIGN PATENT DOCUMENTS

| | | | |
|---|---|---|---|
| 3144077 | 11/1981 | Fed. Rep. of Germany . | |
| 0881239 | 4/1943 | France | 51/206 P |

*Primary Examiner*—Frederick R. Schmidt
*Assistant Examiner*—Robert A. Rose
*Attorney, Agent, or Firm*—W. G. Fasse; D. H. Kane, Jr.

[57] ABSTRACT

A grinding disk with an interrupted, circumferentially contoured surface for sanding or polishing a respectively contoured work piece surface has a plurality of sector-type grinding disk elements secured to a hub for rotation with the hub. The disk elements are produced by first casting a straight longitudinal grinding body, which is then cut into said elements, which are secured to the hub with sector spaces between neighboring elements so that the circumference forms a polygon. Substantial savings are achieved because now the hub can be used repeatedly by merely replacing the worn-out grinding body made of the sector-type grinding disks.

3 Claims, 6 Drawing Figures

FIG. 4
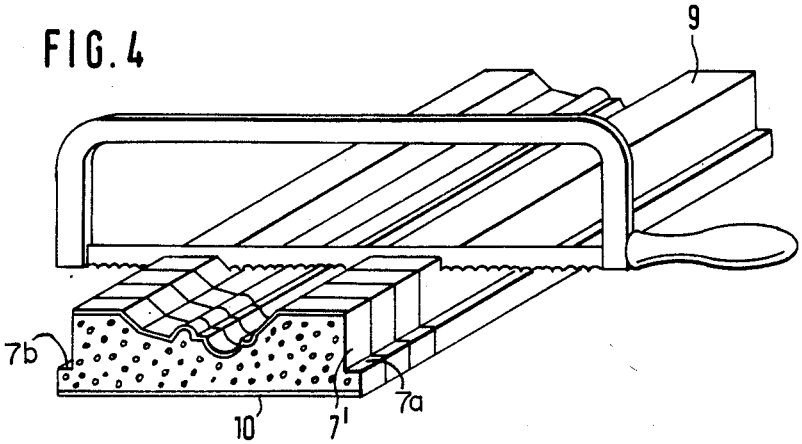
FIG. 5
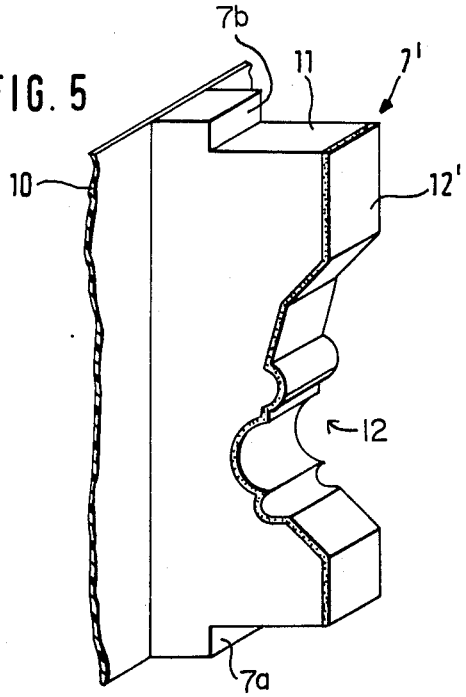
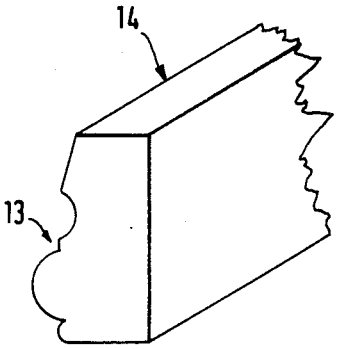
FIG. 6

GRINDING DISK AND METHOD OF MANUFACTURING SUCH A DISK

This application is a division of application Ser. No. 717,075, filed Mar. 28, 1985, now abandoned.

FIELD OF THE INVENTION

The invention relates to a rotary grinding or polishing disk for sanding a molding having a contoured surface. The invention also relates to a method of manufacturing such a grinding or polishing disk.

DESCRIPTION OF THE PRIOR ART

It is known to use grinding disks having a contoured profile in the circumferential surface for sanding or polishing moldings and for sanding or polishing profiled edges of panels. Such disks are used especially in connection with the sanding or polishing of panel edges, when the panel edges do not extend along a straight line but rather along a concave or curved line. The profile in the circumference of the grinding disks forms an exact counterpart to the profile to be sanded or polished.

Prior art profiled grinding disks, in which the grinding or polishing material is rigidly embedded in a grinding body of another material, such as a polyurethane foam, are generally suitable only for a small grinding depth. If a rough grinding with a larger grinding depth or feed advance is intended, such operation causes a high wear and tear on the grinding disk, whereby the disks are used up rapidly. Further, in connection with moldings made of soft wood, the sap wood tends to be removed more than heart wood, whereby the original contouring of the molding may be changed.

On the other hand, profiled grinding disks, in which the grinding or polishing material is embedded in a grinding webbing, which is applied to a body of synthetic material, are very expensive tools, because it is expensive to manufacture this type of conventional grinding disks. It is necessary to provide a mold for the manufacture of rings e.g. synthetic material rings. While it is possible to use the molds repeatedly, the rings still must be covered with the grinding webbing, such as emery cloth and such covering is usually accomplished by bonding the emery cloth with an adhesive to the surface of the rings. Usually narrow strips of grinding cloth or polishing cloth must be applied to the synthetic material rings. This operation is time-consuming and hence costly. Further, when the milling tools, which are used for manufacturing the moldings, have been repeatedly sharpened, it is possible that the contour of the molding will not conform any more to the original contour. As a result, the contour of the synthetic material rings manufactured in the original molds will also not conform any more precisely to the profile or contour of the moldings manufactured with milling tools which have been repeatedly sharpened.

Further, profiled grinding disks comprising an elastic base body are also expensive to manufacture due to the fact, that the user must first bond grinding or emery cloth to a sample of the profile to be ground or polished and then use that sample for forming a counter profile in the circumferential surface of the disk. When the counter profile is formed in the circumferential surface of the disk, such profile must again be covered with grinding or emery cloth by an adhesive bonding or the like. When the grinding or emery cloth becomes dull it must be removed and a new strip must be bonded to the circumferential, profiled surface of the disk. Yet another disadvantage of this type of grinding disk is seen in the fact, that for each profile a different base body is required.

It is also known from U.S. patent application Ser. No. 436,311, filed on Oct. 25, 1982, by Alfred Dettelbach et al now U.S. Pat. No. 4,535,574, to manufacture an elongated straight sanding tool or surface finishing tool with a profiled surface by casting in a mold. For this purpose the profiled body having a surface configuration corresponding to that of the work piece is inserted into a mold. A length of sanding belt or sanding cloth is inserted into the mold, so that the rough surface faces the profiled body forming an insert in the mold. The sanding belt or cloth has a substantial elasticity in the direction across the length of the tool being cast, so that the pressure resulting from casting will cause the sanding belt or cloth to precisely hug the contour of the insert. The mold is filled with a foam material, such as polyurethane and after curing the sanding belt or emery cloth is intimately bonded to the foam material with the desired contour.

OBJECTS OF THE INVENTION

In view of the foregoing it is the aim of the invention to achieve the following objects singly or in combination:

to provide a simple and inexpensive tool of the type described including a method for making such a tool which is also simple and inexpensive, so that tools with many different contours or profiles may be manufactured;

to construct such a grinding disk, so that it will have a substantially improved resistance to wear and tear as compared to conventional grinding disks having a full disk body; and to construct a grinding disk in such a manner, that an efficient cooling effect is achieved, to thereby avoid burning of the molding, especially of the end grain of such moldings.

SUMMARY OF THE INVENTION

According to the invention, there is provided a grinding disk with a hub having secured thereto a plurality of sector-type grinding disk elements cut from an initially straight, longitudinal grinding body, whereby these disk elements extend radially around the hub. Preferably, the elements are all held together by an elastic belt forming a backing which is not cut, when the longitudinal grinding body is severed into a plurality of such disk elements. The elastic belt backing is then placed around the hub and secured thereto for example, by an adhesive bond for rotation with the hub. The attachment of the disk elements around the hub is preferably such, that free sector spaces are formed between neighboring grinding disk elements. In an alternate embodiment the disk elements are held in place by two covers, at least one of which is provided with axially and inwardly facing grooves extending radially in the respective cover, preferably in both covers, so as to hold the axial ends of the respective disk elements.

Advantages of the invention are seen in that grinding disks may be economically manufactured even at small production numbers, so that many different profiles or contours may be made available while simultaneously assuring a high profile or contour precision. Further, it is no longer necessary to exchange the entire disk since the hub can be re-used for attaching new or replacement disk elements or for attaching disk elements with a different profile. Further, by using polyurethane foam as a material for casting the grinding body, the resulting disks have a certain pressure elasticity and achieve a high grinding and polishing quality as well as a good wear resistance.

Due to the arrangement of the sector-type grinding disk elements in a spoke-type or fan-type distribution around the hub, a self-cleaning effect of the grinding surfaces has been achieved because the grinding dust can move into the free spaces between neighboring disk elements, whereby a substantial increase of the wear resistance of the present grinding disks is obtained. Simultaneously, the same arrangement with the sector-shaped free spaces between neighboring disk elements provides a ventilation effect during operation, whereby the grinding disk itself and also the work piece is cooled or at least heated substantially less, than is the case in connection with prior art grinding disks. This advantage is especially important in connection with grinding moldings having a substantial end grain proportion, because the cooling reduces the burning tendency of the wood.

BRIEF DESCRIPTION OF THE DRAWINGS

In order that the invention may be clearly understood, it will now be described, by way of example, with reference to the accompanying drawings, wherein

FIG. 4 is a perspective view of a straight longitudinal cast grinding body, which is being cut into a plurality of disk elements or sections;

FIG. 5 is a perspective view of one disk element; and

FIG. 6 shows a perspective view of a piece of molding having a profiled surface that may be ground or polished with a grinding disk according to the invention.

DETAILED DESCRIPTION OF PREFERRED EXAMPLE EMBODIMENTS AND OF THE BEST MODE OF THE INVENTION

Figure 1:
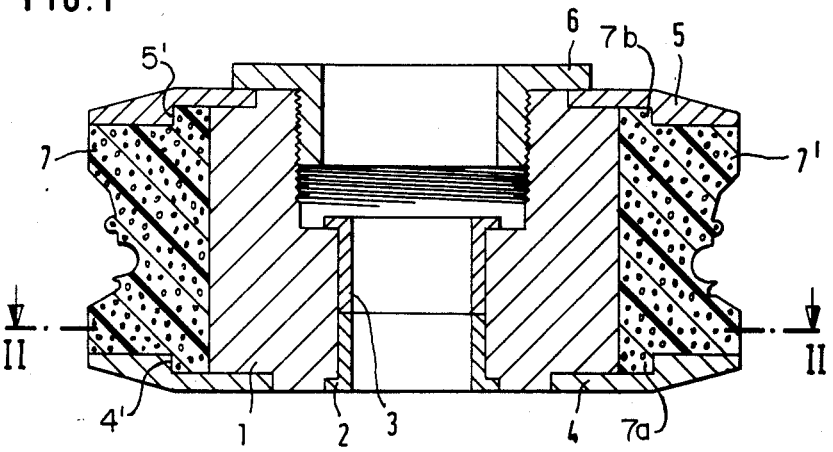
FIG. 1 shows a sectional view through a grinding disk according to the invention.

The grinding or polishing disk according to the invention as shown in FIG. 1 comprises a hub 1 which may be provided with different centering bushings 2 and 3 depending on the type of drive shaft of the tool, to which the present disk may be attached. The disk further comprises the grinding body 7 secured to the hub 1 for rotation with the hub. The grinding body 7 may be attached to the hub by two clamping covers 4, 5. The cover 4 is secured to the hub 1 by screws not shown. The cover 5 is held in place by a clamping nut 6 provided with an external threading mating with an internal threading of the hub and with a flange bearing against the cover 5. In order to secure the grinding body 7 to the hub 1, at least one of the covers 4 or 5 is provided with a shoulder 4' or 5', which faces radially inwardly for cooperation with a respective shoulder 7*a* or 7*b* of the grinding body. Preferably, both covers 4,5 are provided with such shoulders 4', 5'.

Rather than using the clamping covers 4 and 5, it is also possible to bond the grinding body 7 to the hub 1 by a suitable adhesive resulting in a still less expensive tool.

Figure 2:
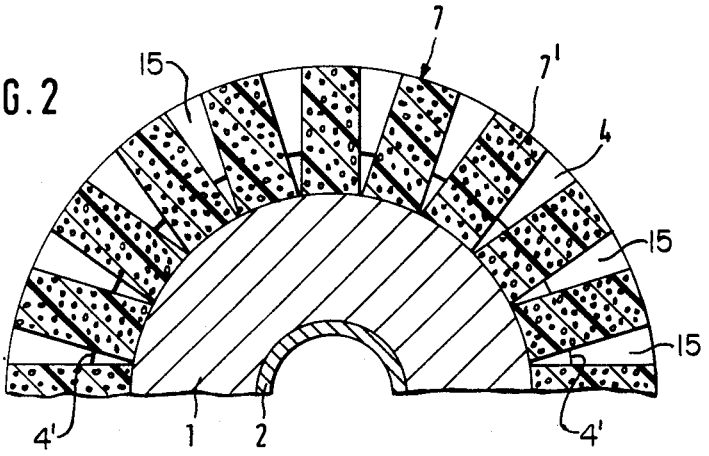
FIG. 2 is a partial sectional view through the disk of FIG. 1 along section line II—II.

As shown in FIG. 2 the grinding body 7, according to the invention, comprises a plurality of sector-type disk elements 7' which fan out from the hub 1 in a spoke-type arrangement, whereby sector-shaped free spaces 15 are formed between neighboring disk elements 7'. These free spaces 15 provide the above mentioned fan effect, which in turn cools the tool and the work piece. As best seen in FIGS. 2, 4, and 5, the individual sector type disk elements 7' have a uniform thickness in the circumferential direction in FIG. 2 and in the longitudinal direction in FIG. 4. This thickness is the same or uniform throughout these disk elements including their radially inner end and their radially outer end in FIG. 2 and also the same or uniform at the bottom and top in FIG. 4, whereby the desired free spaces 15 are formed automatically when the body 9, after cutting, is wrapped around the hub 1 as described below.

Figure 3:
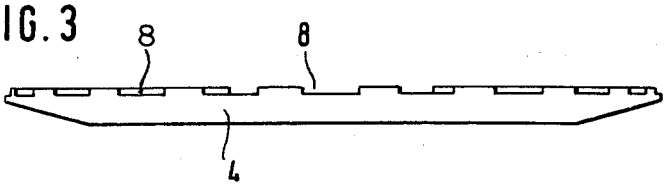
FIG. 3 is a side view of one of the clamping covers forming part of the disk of FIG. 1.

FIG. 3 shows a side view of the clamping cover 4 provided with grooves 8, which are so spaced from each other around the inwardly facing surface of the cover 4, that each disk element 7' fits with one of its axial ends into one of these grooves. A sufficient rigidity is achieved by providing only one cover with the grooves 8. However, it may be preferable to provide both covers with such grooves.

FIG. 4 illustrates an initially straight elongated grinding body 9 produced as taught in the above mentioned U.S. Pat. No. 4,535,574, however, with the modification, that an elastic belt 10 is bonded to the back surface of the grinding body 9. When the grinding body is cut, for example by a hack saw or by any other suitable tool, the cutting of the individual sector-type disk elements 7' is stopped before cutting through the elastic belt backing 10. Thus, when the cutting is completed, all the elements are held together by the elastic belt 10, which may be wrapped around the hub 1 as shown in FIG. 2. Incidentally, the backing 10 may be provided with an adhesive, preferably a contact adhesive, for securing to the hub 1. Prior to attaching such set of disk elements 7' with their elastic belt backing 10 to the hub 1 such adhesive may be protected by a peel-off layer not shown. Such adhesives and peel-off layers are as such conventional.

Referring to FIG. 5, the individual sector-type disk elements 7' may be made of a cast or molded polyurethane body 11 having the contoured surface 12 provided with sanding or emery cloth 12' as described in more detail in the above mentioned U.S. Pat. No. 4,535,574. The elastic backing belt 10 may be a webbing of strong cloth or fiberglass or the like. The contoured surface 12 of each disk element 7' conforms precisely to the contoured surface 13 of a work piece 14 to be sanded by a disk according to the invention. Such a work piece 14 is shown in FIG. 6.

Although the invention has been described with reference to specific example embodiments, it will be appreciated, that it is intended to cover all modifications and equivalents within the scope of the appended claims.

What is claimed is:

1. A method for manufacturing a disk wheel having an interrupted circumferential contoured grinding surface, comprising the following steps:

(a) casting with foam material a substantially straight elongated grinding body having a contoured grinding surface and a flat surface opposite said contoured surface, bonding a belt of sanding cloth to said contoured grinding surface and a belt of flexible material to said flat surface as a result of said casting of said foam material which cures and thereby bonds to said sanding cloth and to said belt of flexible material, said flexible belt and said belt of sanding cloth being inserted into a mold prior to casting said elongated grinding body in said mold, (b) cutting said foam material grinding body into a plurality of grinding disk elements by severing through said belt of sanding cloth and through said foam material grinding body but without severing said flexible belt, whereby said grinding elements remain bonded to said flexible belt, and (c) substantially rigidly securing said flexible belt carrying said grinding disk elements to a hub means for rotation with said hub means.

2. The method of claim 1, wherein said severing of said elongated grinding body is performed in planes extending in parallel to each other and perpendicularly to a longitudinal axis of said elongated grinding body, whereby each resulting grinding element has a uniform thickness.

3. The method of claim 1, further comprising spacing said grinding disk elements uniformly around said hub.

* * * * *